US007571614B2

(12) United States Patent
Lejars et al.

(10) Patent No.: US 7,571,614 B2
(45) Date of Patent: Aug. 11, 2009

(54) TURBOSHAFT ENGINE COMPRISING TWO SUBASSEMBLIES ASSEMBLED UNDER AXIAL STRESS

(75) Inventors: Claude Lejars, Draveil (FR); Marica Mesic, Dammarie-les-Lys (FR); Bruce Pontoizeau, Paris (FR); Alexandre Roy, Antony (FR); Patrice Suet, Montgeron (FR)

(73) Assignee: Snecma, Paris (FR)

( * ) Notice: Subject to any disclaimer, the term of this patent is extended or adjusted under 35 U.S.C. 154(b) by 629 days.

(21) Appl. No.: 11/086,359

(22) Filed: Mar. 23, 2005

(65) Prior Publication Data

US 2005/0260066 A1 Nov. 24, 2005

(30) Foreign Application Priority Data

Mar. 26, 2004 (FR) ..... 04 03128

(51) Int. Cl.
*F02C 7/20* (2006.01)

(52) U.S. Cl. ..... 60/796; 60/797; 60/798; 415/138; 415/174.2

(58) Field of Classification Search ..... 60/786, 60/796–799, 805; 415/115, 138, 170.1, 174.2, 415/220; 277/644, 647
See application file for complete search history.

(56) References Cited

U.S. PATENT DOCUMENTS

| | | | | |
|---|---|---|---|---|
| 5,320,484 | A | 6/1994 | Charbonnel et al. | |
| 5,964,575 | A * | 10/1999 | Marey | 415/115 |
| 6,402,466 | B1 * | 6/2002 | Burdgick et al. | 415/173.3 |
| 6,450,762 | B1 * | 9/2002 | Munshi | 415/138 |

FOREIGN PATENT DOCUMENTS

| | | |
|---|---|---|
| EP | 0 236 567 A1 | 9/1987 |
| FR | 2 646 221 | 10/1990 |
| WO | WO 03/054358 A1 | 7/2003 |

OTHER PUBLICATIONS

Patent Abstracts of Japan, JP 11343809, Dec. 14, 1999.

* cited by examiner

*Primary Examiner*—Michael Cuff
*Assistant Examiner*—Phutthiwat Wongwian
(74) *Attorney, Agent, or Firm*—Oblon, Spivak, McClelland, Maier & Neustadt, P.C.

(57) ABSTRACT

Turboshaft engine including two subassemblies defining between them an annular chamber housing a seal. The two subassemblies are assembled under axial stress thereby defining an annular chamber housing the seal and an interposed part is inserted between the butting surfaces of the two parts of the annular chamber.

10 Claims, 1 Drawing Sheet

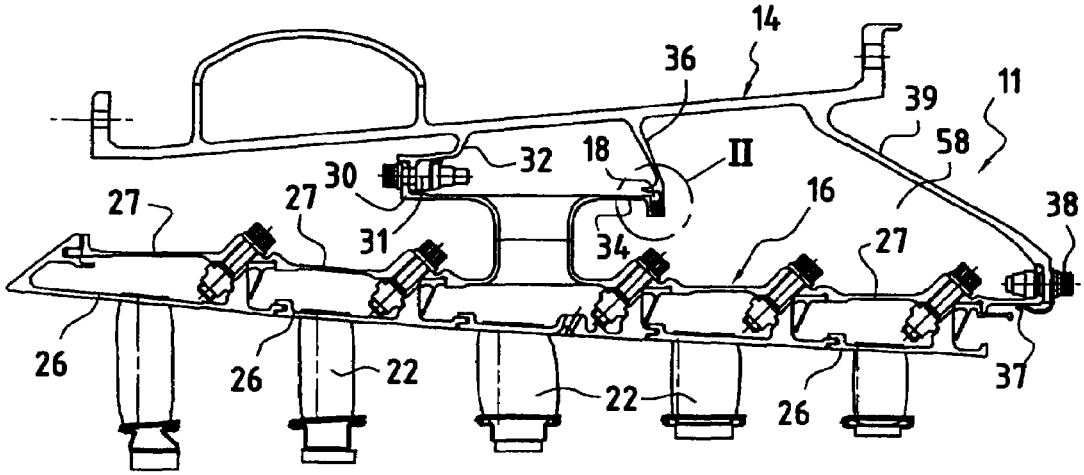
FIG.1
PRIOR ART
FIG.2
PRIOR ART
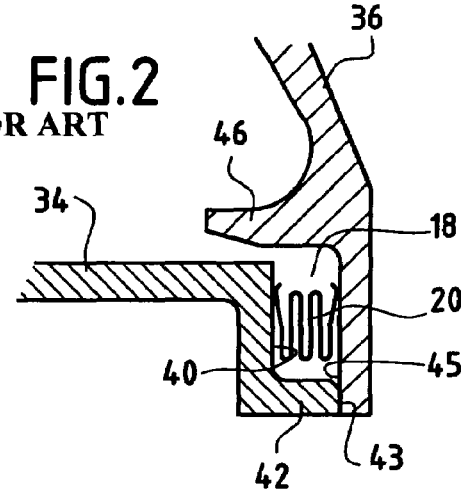
FIG.3
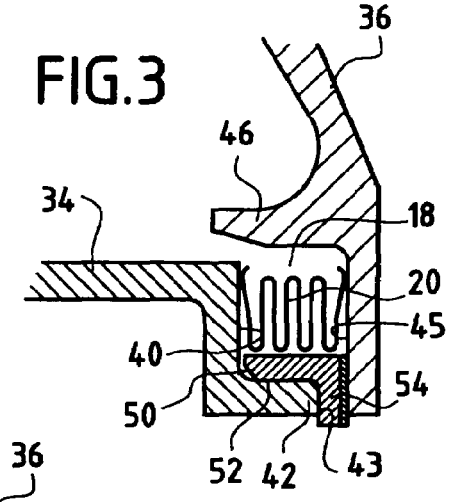
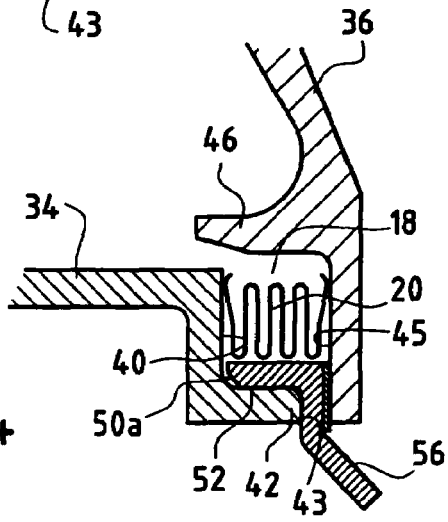
FIG.4

TURBOSHAFT ENGINE COMPRISING TWO SUBASSEMBLIES ASSEMBLED UNDER AXIAL STRESS

BACKGROUND OF THE INVENTION

1. Field of the Invention

The invention relates in general to a turboshaft engine, in particular a turbocompressor whose task is to supply the combustive air, under pressure, to the combustion chamber of an aircraft jet engine. It relates more particularly to a refinement strengthening the sealing of the junction between two subassemblies of such a machine, for example the junction under stress between a casing and a fixed blades support of the stator.

2. Discussion of the Background

In a turbocompressor of the type mentioned above, the stator is assembled with an outer casing. In order to prevent air leakages, two subassemblies, of the casing and of the stator, are shaped in order to define between them an annular chamber in which a seal is inserted. The latter bears against two annular walls that face one another and that are respectively part of the two subassemblies. The two annular parts in contact with the two subassemblies are applied against each other under axial stress. The stress can be expressed in millimeters, this value denoting the axial interference which would exist between the two subassemblies if the latter were not butted against one another under stress. Up to the present time, relatively low stresses have been used, traditionally of the order of 0.3 mm. More recently, this stress has been raised to 0.75 mm.

During certain operational phases, the chamber housing the seal can open under the effect of distortions due to heat. Moreover, during operation the seal undergoes distortions and wear which can even cause a loss of fragments which, driven by the pressure difference, become jammed between the facing surfaces of the annular chamber. These surfaces are damaged and the air leakages increase.

SUMMARY OF THE INVENTION

The purpose of the invention is to prevent the opening of the chamber to prevent the release of pieces of the seal and damage to the surfaces against which it rests.

More particularly, the invention relates to a turboshaft engine comprising at least two subassemblies assembled with each other and defining between them an annular chamber housing a seal, characterized in that two annular parts in contact respectively being part of the two subassemblies and defining the said chamber are stressed against each other, in a way that is known per se, with axial stress and in that an annular interposed part is inserted between their butting surfaces.

When such an annular interposed part (called a "martyr" part) is installed between the two subassemblies, the axial stress can be considerably increased. It can in particular be between 1.5 and 3 mm. A currently preferred stress value is close to 2.25 mm. This heavy assembly stress makes it possible to absorb variations due to heat and thus prevents the opening of the chamber and the destruction of the seal. This part is inexpensive and easy to change if it is damaged. Consequently, the two subassemblies are protected and there is no longer a risk of them being damaged. The arrangement is such that the contact area between the two butting subassemblies is increased. This results in a reduction of the hammering pressure and better behavior with respect to relative displacements between the subassemblies. Furthermore, it is relatively easy to carry out a surface treatment of this interposed part, improving its strength. The invention particularly applies to the connection between an outer casing and a stator component carrying the fixed blades of a turbocompressor.

BRIEF DESCRIPTION OF THE DRAWINGS

The invention will be better understood and its other advantages will become more apparent in the light of the following description, given solely by way of example and with reference to the appended drawings in which:

FIG. 1 is a diagrammatic view showing two assembled subassemblies and constituting a part of a turbocompressor, the assembly being conventional, with axial stress in the vicinity of a seal chamber;

FIG. 2 is a diagrammatic view at a larger scale of the circled section II of FIG. 1;

FIG. 3 is a view similar to that of FIG. 2 showing the refinement according to the invention; and FIG. 4 is a view similar to that of FIG. 3 showing a variant.

DETAILED DESCRIPTION OF THE PREFERRED EMBODIMENTS

Considering more particularly FIGS. 1 and 2 relating to the prior art, there has been shown a turbocompressor 11 being part of the constitution of an aircraft jet engine. Two subassemblies 14, 16 are assembled under axial stress and defining between them an annular chamber 18 inside of which is inserted a seal 20. The subassembly 14 constitutes an outer casing whereas the subassembly 16 constitutes the support for a plurality of fixed blades 22 of the turbocompressor. The mobile blades, which are not shown, are situated between the fixed blades. The fixed blades support is constituted by several segments 26, assembled end to end, each segment carrying a series of fixed blades. The support assembly is fixed to an inner casing 27. This inner casing extends radially outwards by three annular rings, a first ring 30 is fixed by a set of bolts 31 to a first internal member 32 of the outer casing, a second ring 34 bears without stress against a second inwardly extending member 36 of the outer casing. The third ring 37 is fixed by a set of bolts 38 to an internal member 39 of the outer casing 14.

As seen more clearly in FIG. 2, the second ring 34 comprises a flat annular surface 40 extending radially inwards, extended by an axial cylindrical portion 42 bearing by its circular area 43 against the said second member 36. More particularly, the latter comprises another flat annular surface 45 facing that of the ring, surmounted by an approximately tubular protrusion 46 covering, with clearance, an outer cylindrical part of the second ring. This arrangement therefore defines the annular chamber 18 inside of which is installed the seal 20 which bears against the two flat surfaces 40, 45. As mentioned above, the dimensioning of the subassemblies 14, 16 is such that the assembly is made with a stress caused by the tightening of the bolts 31. This stress is therefore applied between the circular area 43 of the second ring and the inner end of the flat surface 45 of the second member. The arrangement described up to the present time is conventional. However, the assembly stress was relatively low, of the order of 0.3 mm. In certain cases, the stress has been increased up to 0.75 mm without being able to completely solve the problem of leakages and the destruction of the seal, as explained above.

The invention is shown in FIG. 3 and proposes the placing of an annular interposed part 50 between the butting surfaces of the two subassemblies, that is to say in this case between the circular area 43 of the ring 34 and the circular end of the flat surface 45 of the member 36. The presence of this part 50 makes it possible to increase the fitting stress which can henceforth be between 1.5 mm and 3 mm, typically at about 2.25 mm. In fact, it can be seen that the interposed part 50 is shaped to increase the contact area at the end of at least one of the annular parts, in this instance more particularly the flat surface 45 of the said second member 36. Furthermore, the axial cylindrical portion 42 of the ring makes it possible to guide the positioning of the interposed part 50 due to the fact that the latter comprises a cylindrical surface 52 fitting itself onto the said cylindrical portion 42. A radial portion 54 of the interposed part bears against the flat surface 45 of the said second member. Globally, as clearly seen in FIG. 3, the radial cross-section of the interposed part 50 is therefore L-shaped. The interposed part can undergo a surface treatment, before fitting, increasing its strength. The treatment can, in particular, apply to the radial portion 54. It is not therefore necessary to apply a treatment of this type to the ring or to the member.

As a variant, as shown in FIG. 4, the interposed part 50*a* extends inwardly by a section forming a deflector 56. In the example, this section has a substantially conical shape. Thus, in the event of residual leakage, the hot air no longer strikes the inner casing locally but is diffused into the chamber 58 defined between the casing and the blades support.

The invention claimed is:

1. A turboshaft engine comprising:

a first subassembly forming an outer casing and having a first internal member and a second internal member;

a second subassembly comprising a ring fixed by a set of bolts to the first internal member of said first assembly, said second subassembly further comprising a second ring in thrust relationship with the second internal member of said first subassembly, wherein an axial stress is caused between said second subassembly and said second internal member of the first subassembly when tightening said bolts, wherein cooperating portions of said second subassembly and of said second internal member define an annular chamber;

a seal inserted in said annular chamber, and an annular part inserted between a first butting surface of said first subassembly and a second butting surface of said second subassembly, wherein the first butting surface of said first subassembly axially abuts against a first portion of said annular part and a second butting surface of said second subassembly axially abuts against a second portion of said annular part, said first portion being axially opposite to said second portion such that said annular part transfers said axial stress between said first and second subassemblies via said first and second butting surfaces, said butting surfaces being located radially internally with respect to said seal, and wherein a contact area of said first butting surface in contact with said first portion is larger than a contact area of said second butting surface in contact with said second portion so as to increase an axial contact between the second subassembly and the second internal member of the first subassembly thereby preventing an opening of said annular chamber and a destruction of said seal.

2. The turboshaft engine as claimed in claim 1, wherein said axial stress between said second subassembly and said second internal member is between 1.5 and 3 mm.

3. The turboshaft engine as claimed in claim 1, wherein one of the second subassembly or the second internal member comprises a cylindrical portion and wherein said annular part comprises a cylindrical surface fitting onto said cylindrical portion and a radial portion bearing against a flat surface of the other of said second subassembly or said second internal member.

4. The turboshaft engine as claimed in claim 3, wherein the radial portion of said annular part is L-shaped.

5. The turboshaft engine as claimed in claim 1, wherein said annular part is extended by a section forming a deflector.

6. The turboshaft engine as claimed in claim 1, wherein the first and second subassemblies constitute a casing and a stator component respectively.

7. The turboshaft engine as claimed in claim 1, wherein said seal extends axially in said annular chamber between said second subassembly and said second internal member of said first subassembly.

8. The turboshaft engine as claimed in claim 7, wherein said second subassembly supports a plurality of fixed stator blades, said second ring extends radially between said stator blades and said second internal member of said first subassembly.

9. The turboshaft engine as claimed in claim 8, wherein said annular part has a cylindrical portion extending around said stator blades.

10. The turboshaft engine as claimed in claim 2, wherein said axial stress is about 2.25 mm.

* * * * *